United States Patent [19]

Jones et al.

[11] Patent Number: 4,938,715

[45] Date of Patent: Jul. 3, 1990

[54] SHOCK SAFE FUSE HOLDER AND PULLER COVER

[75] Inventors: William H. Jones, Villa Park; William R. Bailey, Glen Ellyn, both of Ill.

[73] Assignee: Reed Devices, Inc., Carol Stream, Ill.

[21] Appl. No.: 347,997

[22] Filed: May 5, 1989

[51] Int. Cl.[5] ..... H01R 9/24

[52] U.S. Cl. ..... 439/621; 439/718; 361/430; 337/188

[58] Field of Search ..... 439/621, 622, 709, 718; 337/187, 188, 208, 251; 361/405, 430

[56] References Cited

U.S. PATENT DOCUMENTS

| | | | |
|---|---|---|---|
| 1,023,326 | 4/1912 | Murray | 439/709 |
| 2,124,083 | 7/1938 | Rypinski | 361/430 |
| 3,172,720 | 3/1965 | Teuscher et al. | 439/709 |
| 3,351,893 | 11/1967 | Parris et al. | 439/709 |
| 3,813,626 | 5/1974 | Cetola et al. | 337/245 |
| 3,836,826 | 9/1974 | Hotchkiss et al. | 439/910 |
| 4,094,212 | 6/1978 | Hyams et al. | 81/3.8 |
| 4,126,368 | 11/1973 | Godfrey et al. | 339/91 |
| 4,128,024 | 12/1978 | Hyams et al. | 81/3.8 |
| 4,721,862 | 1/1988 | Cooper | 361/430 |
| 4,806,118 | 2/1989 | Herrmann | 361/430 |

FOREIGN PATENT DOCUMENTS

| | | | |
|---|---|---|---|
| 579357 | 7/1946 | United Kingdom | 439/709 |

*Primary Examiner*—Gary F. Paumen

*Attorney, Agent, or Firm*—Weingarten, Schurgin, Gagnebin & Hayes

[57] ABSTRACT

An electrical terminal block adapted for mounting on a printed circuit board and having integral fuse receptacles for each pair of electrical terminals, and a cover which provides a shock-safe fuse holder and extractor is disclosed. During insertion, the cover loosely retains the fuse while applying pressure only to the end caps. Only when a spent fuse is extracted is any force applied against the body of the fuse. The cover also furnishes visual access of the fuse element while maintaining electrical isolation.

17 Claims, 4 Drawing Sheets

SHOCK SAFE FUSE HOLDER AND PULLER COVER

FIELD OF THE INVENTION

This invention relates to electrical terminal blocks, and in particular, to an electrical terminal block having fuse receptacles integral therewith.

BACKGROUND OF THE INVENTION

Electrical terminal blocks are well known in the art and are often mounted on printed circuit boards to provide an array of terminals for input and/or output connection. It is often required to provide fuses for the electrical circuits contained on the circuit board, and conventionally the fuses have been provided in separate fuse receptacles contained on the circuit board or associated with the circuit board. The fuses must be electrically interconnected to the terminals of the terminal block, which necessitates the manual wiring between the terminal block terminals and respective fuses. Such manual wiring is time consuming, labor intensive, expensive and does not lend itself to automated fabrication of completed circuit boards containing fuses and terminal blocks. The use of separate terminal blocks and fuse holders requires requisite space on the circuit board for such components, which space is often at a premium and which limits the usable circuit board surface area which might otherwise be employed to better advantage for the associated circuit topologies contained on the board.

SUMMARY OF THE INVENTION

The present invention provides an electrical terminal block having integral fuse receptacles for each pair of electrical terminals of the block, and a cover which provides a shock safe fuse holder and extractor. The integral unit containing both the terminals and the fuses can be automatically mounted to a circuit board with automatic assembly equipment, occupies less space on the board than conventional separate terminal block and fuse holder elements, and requires no external wiring between the fuses and block terminals. For insertion of a fuse, the cover for the intended fuse position loosely retains the fuse and applies pressure only to the end caps of the fuse. Extraction of a spent fuse is accomplished by removal of the cover which includes an extractor operative to move the spent fuse from its mounting. The cover also furnishes visual access of the fuse element while maintaining electrical isolation of the fuse.

DESCRIPTION OF THE DRAWINGS

The invention will be more fully understood from the following detailed description taken in conjunction with the accompanying drawings in which.

DETAILED DESCRIPTION OF THE INVENTION

Figure 1:
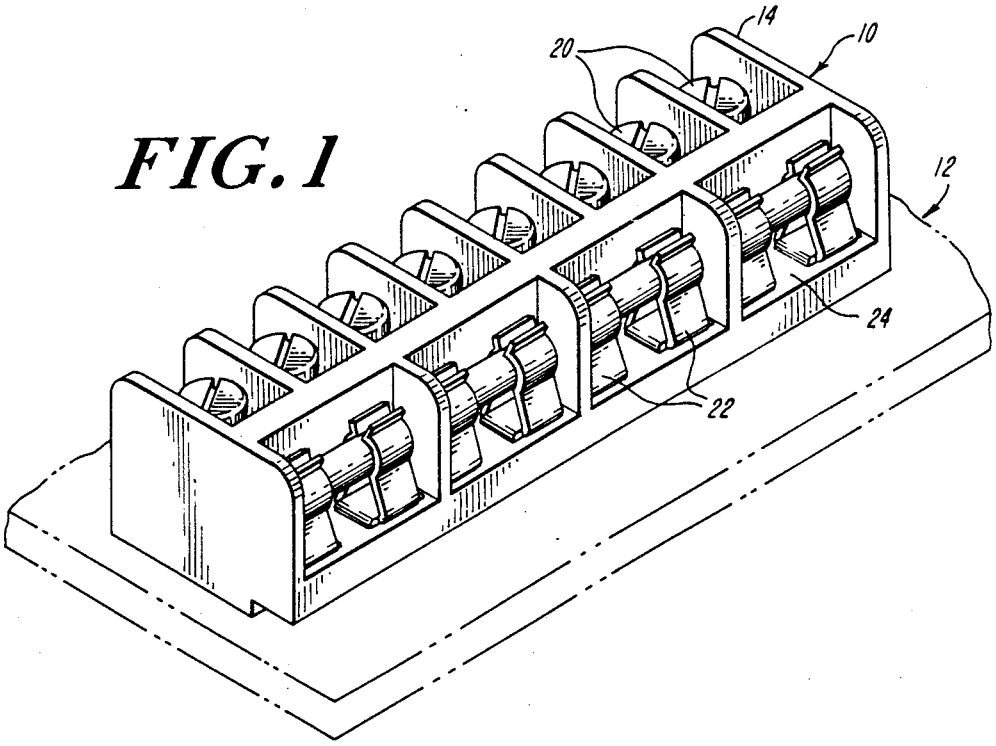
FIG. 1 is a perspective view of the terminal block assembly without detachable cover of the present invention in use on a circuit board.
Figure 2:
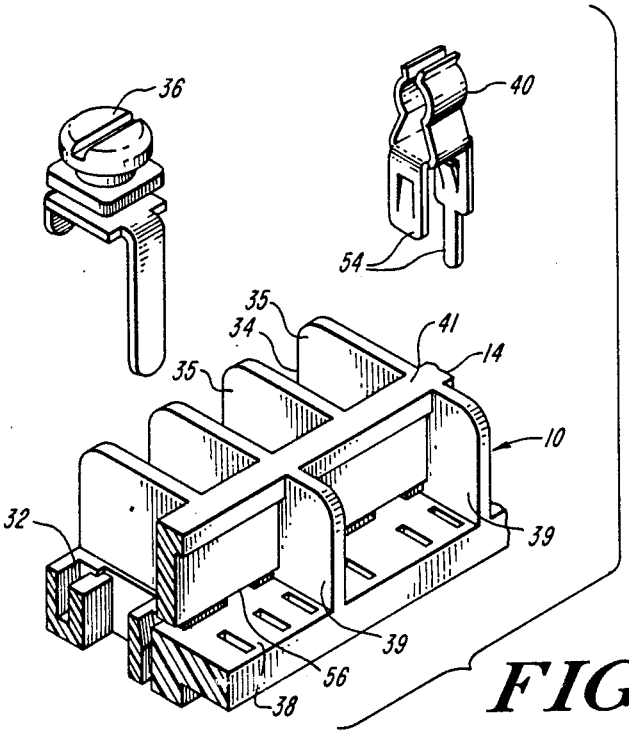
FIG. 2 is a partial exployed view of the terminal block assembly of FIG. 1.

One embodiment of a terminal block assembly according to the present invention is shown generally at 10 in FIG. 1. The terminal block assembly 10 is adapted for mounting on a circuit board 12. Terminal block assembly 10 comprises a housing 14 in which is disposed a row of terminals 20. The terminals are shown as screw type terminals, but other suitable terminals may be used. Within the housing 14 of the terminal block assembly 10 is a means for retaining a fuse, hereinafter referred to as fuse receptacle 22, disposed in cavity or cell 24. The cell 24 is sized to reject fuses of the wrong size and amperage and to accept only correctly sized fuses. Each fuse receptacle 22 may be electrically connected to one of the terminals 20. In the embodiment shown in FIG. 1, each fuse is associated with two screw terminals 20; however, each fuse could be associated with any number of screw terminals 20 rather than with pairs of terminals as shown in FIG. 1.

In FIGS. 2–5, a section of the terminal block assembly 10, shown in FIG. 1, and its parts are displayed in greater detail. The housing 14 of terminal block assembly 10 comprises a terminal housing 32 and a fuse housing 38. The terminal housing has a row of cavities 34 defined by walls 35 in which are disposed screw terminals 36. The fuse housing 38 has a row of cells 24 defined by walls 39 and is disposed in the rear of the terminal housing 32 and adjacent to the terminals 36. A central barrier wall 41 separates cavities 34 and cells 24. Fuse receptacle 22, comprised of two fuse clips 40, is mounted in each cell 24 within housing 38. Each fuse receptacle may be electrically associated to its adjacent terminal.

Figure 3:
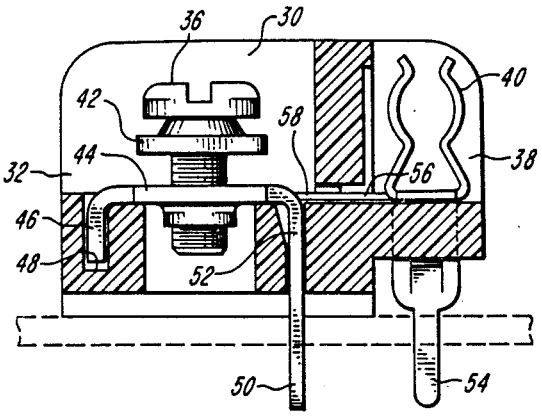
FIG. 3 is a cross-sectional view of the terminal block assembly of FIG. 2.
Figure 4:
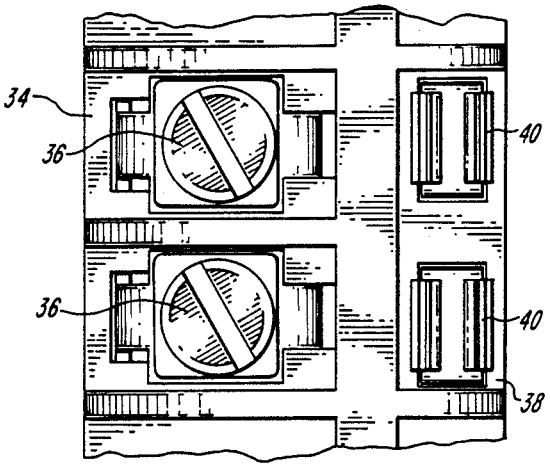
FIG. 4 is a partial top plan view of the terminal block of FIG. 1.

Terminal 36 is shown in more detail in FIG. 3. A cable or wire, not shown, is connected to the terminal 36 by clamping between the screwhead clamp plate 42 and a conductive plate 44. Plate 44 includes a first leg 46 which extends into recess 48 in housing 32 and a second leg 50 which extends through recess 52 in housing 32. Recess 52 is open at the bottom of housing 32 so that the leg 50 can extend beyond housing 32 to be inserted into a printed circuit board (shown in dotted lines) for electrical connection to fuse receptacle 22 or other circuitry as needed.

Figure 5:
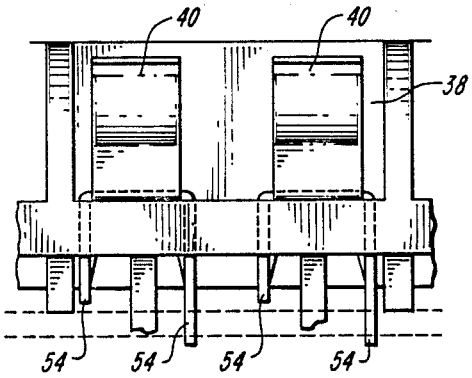
FIG. 5 is a partial side view of FIG. 4.

Fuse receptacles 22 are mounted in housing 38 in cell 24. The cell may be of any suitable configuration to conform to the configuration of the fuse element to be placed within the fuse receptacle. As shown in FIG. 5, the fuse receptacle 22 comprises a pair of fuse clips 40, each fuse clip including a pair of conductive leads 54 which extend below housing 38 to connect to a printed circuit board. Fuse clips 40 may be electrically connected to terminal 36 through appropriate connections made on the printed circuit board. Alternatively, fuse clips 40 may be connected to terminal 36 by a connection 58 extending through passage 56 in barrier wall 41 of housing 14.

Figure 6:
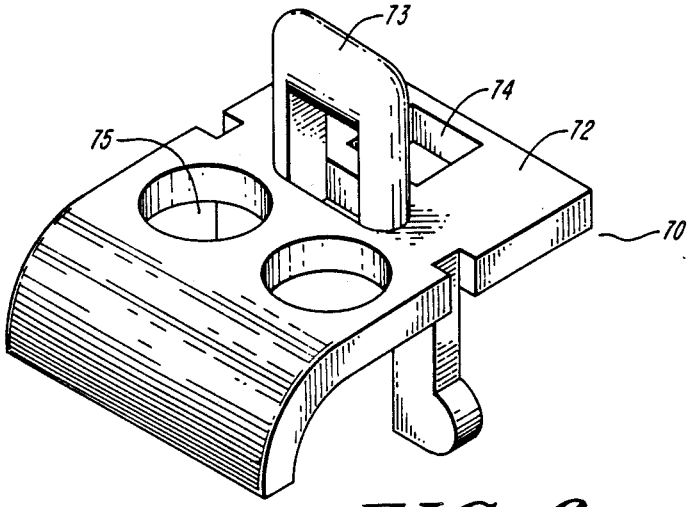
FIG. 6 is a perspective view of a shock safe fuse holder and extractor cover.
Figure 7:
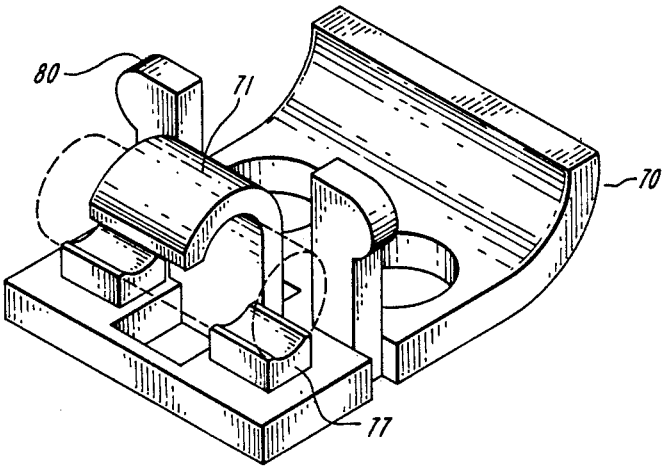
FIG. 7 is a perspective view of the bottom of the cover of FIG. 6.
Figure 8:
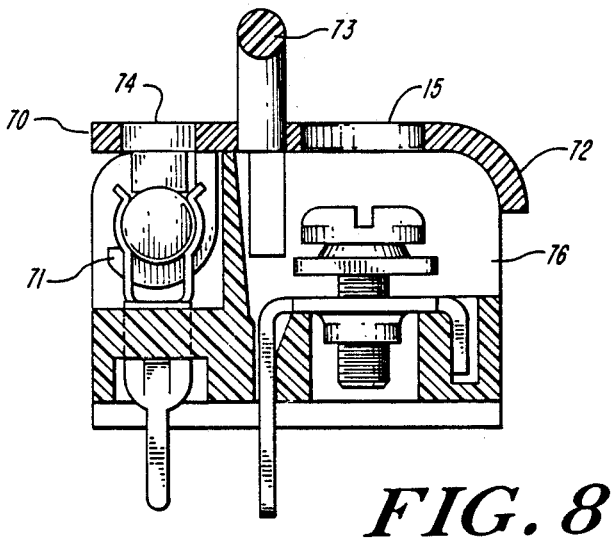
FIG. 8 is a cross-sectional view of the terminal block assembly with detachable cover.

FIGS. 6–8 show a preferred embodiment of cover 70. The cover 70 includes a half cylindrical fuse holder 71 which provides a holding and removing device for a blown fuse. Plate 72 covers the fuse and terminals to protect them from dirt and dust and provides protection against accidental electric shock. Cover 70 is provided with a handle 73 extending from plate 72 to provide easy removal of the cover. A window 74 in cover 70 permits viewing of the fuse element. A terminal portal 75 in cover 70 allows access for a screwdriver or other tool to the terminals without having to remove the cover. When cover 70 is in place, plate 72 also leaves a front opening 76 to allow access for a wire. Semi-circular blocks 77 attached to cover 70 place force only against the two metal end caps of the fuse during insertion. The cover 70 is held in place over the terminal and fuse receptacle by frictional clips 80 which engage housing 32. Although only one embodiment of the cover is shown, other suitable means may be used to extract, insert or view the fuse.

Figure 9:
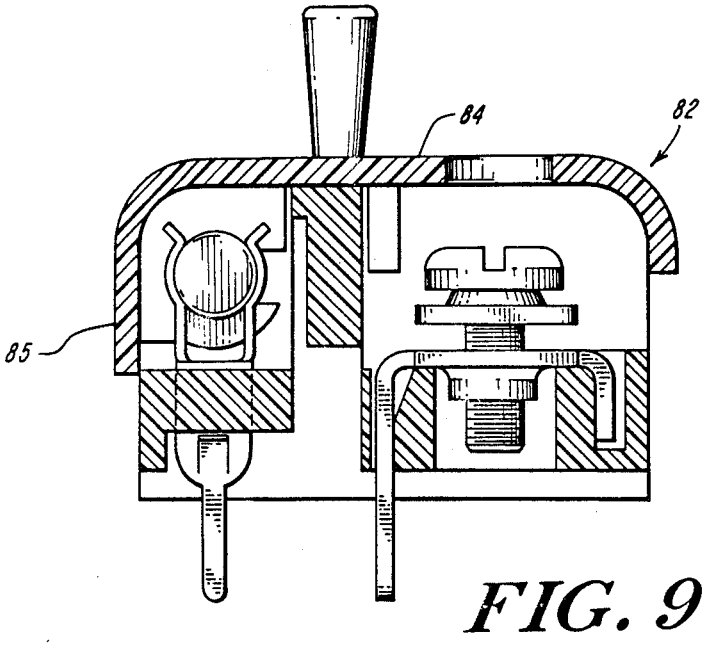
FIG. 9 is a perspective view of an alternative embodiment of terminal block assembly and detachable cover of the present invention.

An alternative embodiment of a cover of FIG. 8 is shown in FIG. 9. The plate 84 of cover 82 includes an external wall 85 which entirely encloses cell 24 to provide greater protection.

The invention is not to be limited by what has been particularly shown and described, except as indicated by the appended claims.

We claim:

1. An electrical terminal block assembly comprising:
a body of electrically insulative material having a first cavity and a second cavity;
means for mounting an electrical terminal in the first cavity;
means for retaining a fuse in the second cavity; and
a cover configured to cover the first and second cavities, the cover including means for inserting a fuse into and extracting the fuse from the fuse retaining means.

2. The electrical terminal block assembly of claim 1, wherein the fuse retaining means comprises means for grasping each end of the fuse, and the fuse inserting and extracting means comprises a cradle to support a central portion of the fuse, the cradle disposed between the fuse end grasping means when the cover is placed over the first and second cavities.

3. The electrical terminal block assembly of claim 2, wherein the cradle depends from an underside of the cover.

4. The electrical terminal block assembly of claim 3, wherein the cover further includes support blocks depending from the underside of the cover to support the ends of the fuse.

5. The electrical terminal block assembly of claim 1, wherein an opening is included in the cover to provide visual access to the fuse.

6. The electrical terminal block assembly of claim 1, wherein an opening is included in the cover to provide access to the electrical terminal.

7. The electrical terminal block assembly of claim 1, further including a handle on the cover.

8. The electrical terminal block assembly of claim 1, further including means for removably attaching the cover to the body.

9. The electrical terminal block assembly of claim 8, wherein the attaching means comprises arms depending from an underside of the cover to frictionally engage with walls of the body.

10. The electrical terminal block assembly of claim 1, further comprising a plurality of said first cavities and a plurality of said second cavities, wherein the terminal mounting means includes means for mounting a terminal in each of the first cavities, and the fuse retaining means includes means for retaining a fuse in each of the second cavities.

11. An electrical terminal assembly for mounting on a printed circuit board, comprising:
a body of electrically insulative material comprising:
a plurality of first cavities and a plurality of second cavities,
a central barrier wall separating the first cavities from the second cavities, and
a plurality of first passages, each continuous with a respective one of the first cavities and extending through the body;
a plurality of electrical terminals, each, disposed in a respective one of the first cavities, each terminal having an electrically conductive leg extending through a respective one of the first passages to electrically connect to the printed circuit board; and
electrically conductive means for accepting and retaining a fuse therein, each conductive means in a respective one of the second cavities.

12. The electrical terminal assembly of claim 11 further comprising a plurality of passages extending through the central barrier wall between selected ones of the first cavities and the second cavities, and an electrical conductor disposed in each of the passages through the central barrier wall to electrically connect selected ones of the electrical terminals and the fuse retaining means.

13. The electrical terminal assembly of claim 11, further comprising a plurality of second passages, each disposed within a respective one of the second cavities and extending through the body, wherein each fuse retaining means includes an electrically conductive leg extending through a respective one of the second passages to connect to the printed circuit board.

14. The electrical terminal assembly of claim 11, wherein the second cavities are sized to prevent use of an inappropriate fuse size.

15. The electrical terminal assembly of claim 11, wherein each of the second cavities is associated with at least two of the first cavities.

16. The electrical terminal assembly of claim 11, wherein each of the second cavities is associated with a corresponding one of the first cavities.

17. The electrical terminal assembly of claim 11, wherein the electrically conductive fuse retaining means are electrically isolated from each other.

* * * * *